United States Patent [19]

Balicki et al.

[11] Patent Number: 4,914,767

[45] Date of Patent: Apr. 10, 1990

[54] SUN DIAL BEACH BLANKET WITH PILLOW

[75] Inventors: Raymond J. Balicki, Dania; Nelson J. Perez, Ft. Lauderdale, both of Fla.

[73] Assignee: Walnel Corporation, Fort Lauderdale, Fla.

[21] Appl. No.: 402,232

[22] Filed: Sep. 5, 1989

[51] Int. Cl.[4] ..... A47G 9/06

[52] U.S. Cl. ..... 5/419; 5/417; 5/441; D6/603; 135/118

[58] Field of Search ..... 5/417–420, 5/482, 434, 436, 441; D6/601, 602, 603; 135/118

[56] References Cited

U.S. PATENT DOCUMENTS

| | | | |
|---|---|---|---|
| 1,496,403 | 6/1924 | Atkinson | 5/419 |
| 2,939,468 | 6/1960 | Boyce | 135/15 |
| 3,646,896 | 3/1972 | Derujinsky | 108/139 |
| 3,828,377 | 8/1974 | Eary, Jr. | 5/465 X |
| 3,829,980 | 8/1974 | Iversen | 33/270 |
| 4,200,942 | 5/1980 | Case | 5/419 |
| 4,231,125 | 11/1980 | Tittl | 5/419 |
| 4,382,306 | 5/1983 | Lickert | 5/441 |
| 4,649,582 | 3/1987 | Cho | 5/434 |

*Primary Examiner*—Alexander Grosz
*Attorney, Agent, or Firm*—Oltman and Flynn

[57] ABSTRACT

A beach blanket has a perimeter and a plurality of tabs of hook and loop type material attached to and spaced about the perimeter. A pillow has matching tabs of hook and loop type material on one side of the pillow for attaching the pillow to any one of the tabs of hook and loop type material on the blanket. The pillow may be inflatable. Sand clamps are used to hold down the blanket. Each of the sand clamps has a spike with a point at one end and a spring-biased clamp section on the spike.

10 Claims, 3 Drawing Sheets

SUN DIAL BEACH BLANKET WITH PILLOW

The invention relates to beach blankets, and more particularly to a beach blanket arranged as a sun dial.

BACKGROUND AND PRIOR ART

For many people an important item to have, particularly at the beach, is a towel or blanket so that they can lie on the beach without becoming covered with sand. Because of the movement of the sun, beach-goers are constantly repositioning themselves and their towels in order to keep facing the sun. For a headrest (pillow), people use tote bags, additional towels, shirts, pants, etc. The same thing occurs on picnics or at a lake shore.

Inventors have in the past sought solutions to the aforesaid problems. U.S. Pat. No. 4,231,125 shows a beach towel arrangement wherein multiple beach towels can be joined along the edges to form larger towels. U.S. Pat. No. 4,200,942 shows a towel or blanket combined with an inflatable pillow. U.S. Pat. No. 2,939,468 shows a clamping peg for a beach towel.

It is accordingly an object of the invention to overcome the drawbacks of the devices of the known art and to provide an improved beach blanket for sunbathing.

SUMMARY OF THE INVENTION

According to the invention, there is provided a beach blanket which has a perimeter, and includes a plurality of tabs of hook and loop type material, such as the ones sold under the trade mark of velcro attached to the blanket, spaced about the perimeter; and a pillow which has matching tabs of hook and loop type material on one side of the pillow serving to attach the pillow to any one of the tabs of hook and loop type material on the blanket.

According to a further feature of the invention, the pillow is inflatable and includes inflating and deflating means.

According to another feature, the invention includes a plurality of sand clamps, each of which has a spike with a point at one end for driving the spike into the sand, and a springbiased clamp section on the spike end for clamping the perimeter of the beach blanket firmly to the ground to prevent it from flapping in the wind.

The sand clamp may have a shaft with a pivot point for folding the clamp.

According to still another feature, the pillow is foldable to form a carrying bag.

The beach blanket according to the invention may have a polygonal shape and have numbers imprinted along its perimeter, and the polygonal shape may be octagonal, or have any other suitable shape. The numbers on the blanket may range from 1 to 12.

According to the invention, the sand clamp includes an upper and a lower clamp shell, and has a hinge for joining said shells. The shell has a perimeter, and there are a plurality of inward facing teeth along the shell perimeter for gripping the edges of the blanket.

A spring may be provided which is in engagement with the shells for spring-biasingly urging the shells together to insure a firm grip on the perimeter of the blanket.

The sun dial beach blanket, according to the invention may have a diameter of approximately six feet, which allows a user to enjoy hours of sunbathing pleasure while eliminating the tedious task of continuously repositioning the towel toward the sun as the day continues on. As the user bathes in the sun's rays, a simple roll over to the next octagonal position will allow the user to follow the sun without ever getting up to reposition the towel. The extra benefit of this towel comes from the inflatable plastic vinyl pillow that is included. When inflated, the pillow becomes a comfortable headrest that will remain securely attached to the blanket by the hook and loop type tabs. As the sun bather rolls over to the next position, the pillow is detached from the previous position and re-attached to the new position. When deflated, it acts as a convenient carrying case for the towel.

The sand clamp is advantageously fabricated from durable plastic and can be in the shape of a clam. Attached to the underside of the clamp is a plastic spike having a sharp or a rounded point, e.g. six inches in length, with spring-loaded clip handles at the clamp's rear. To operate the sand clamps, one simply pushes the spike into the sand or ground until the clamps are flush with the surface, and clips the clamp to points at the edge of the beach towel or blanket to secure it in place from gusts of wind.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
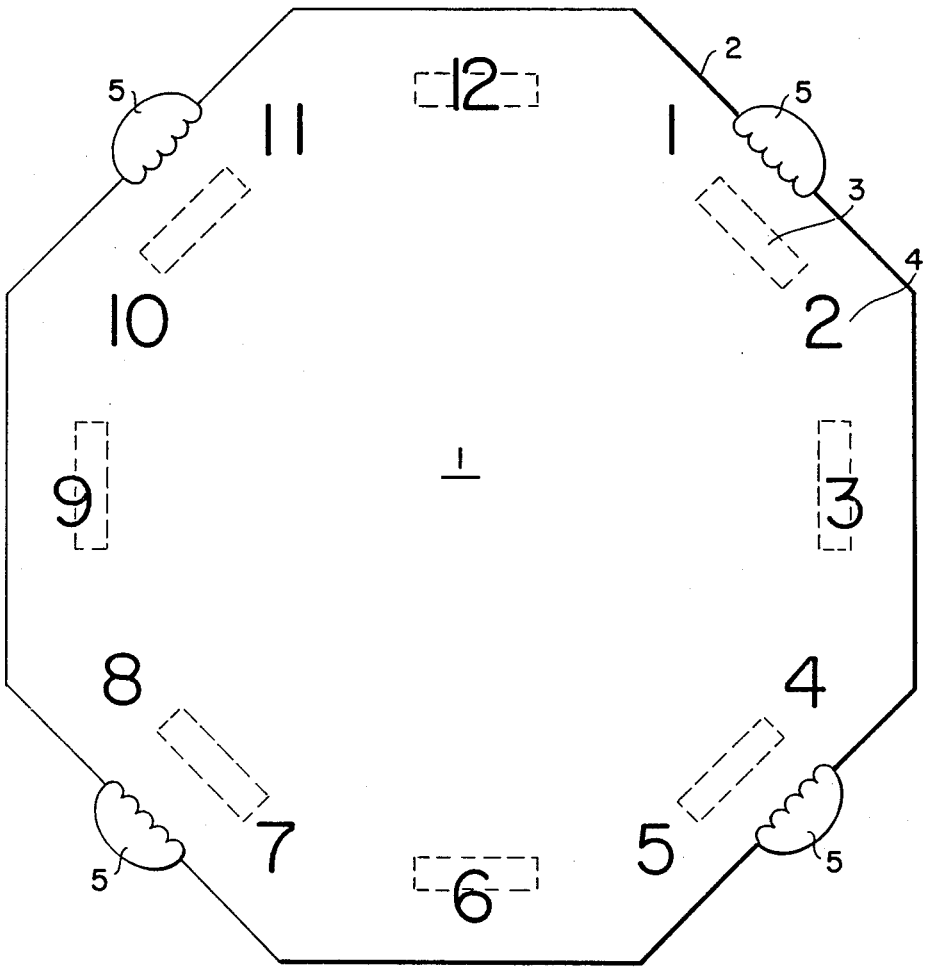
FIG. 1 is a plan view of the invention showing sun dial numbers and hook and loop type tabs.

In FIG. 1 is a beach blanket 1, having a perimeter 2, and a plurality of tabs 3 of hook and loop type material attached at certain points to the perimeter of the blanket.

In the illustrated exemplary embodiment the beach blanket is shown with an octagonal perimeter with a diameter of approximately six feet to allow a person to lie stretched out on the blanket. It follows that the perimeter may have any suitable form, such as circular, polygonal, hexagonal or the like.

The beach blanket may be made of any suitable material such as wool, cotton, synthetic fibers or any combination thereof. Numerals 4, preferably ranging from 1 to 12, may be printed on the top surface of the blanket to indicate the sun's movement across the sky.

Figure 2:
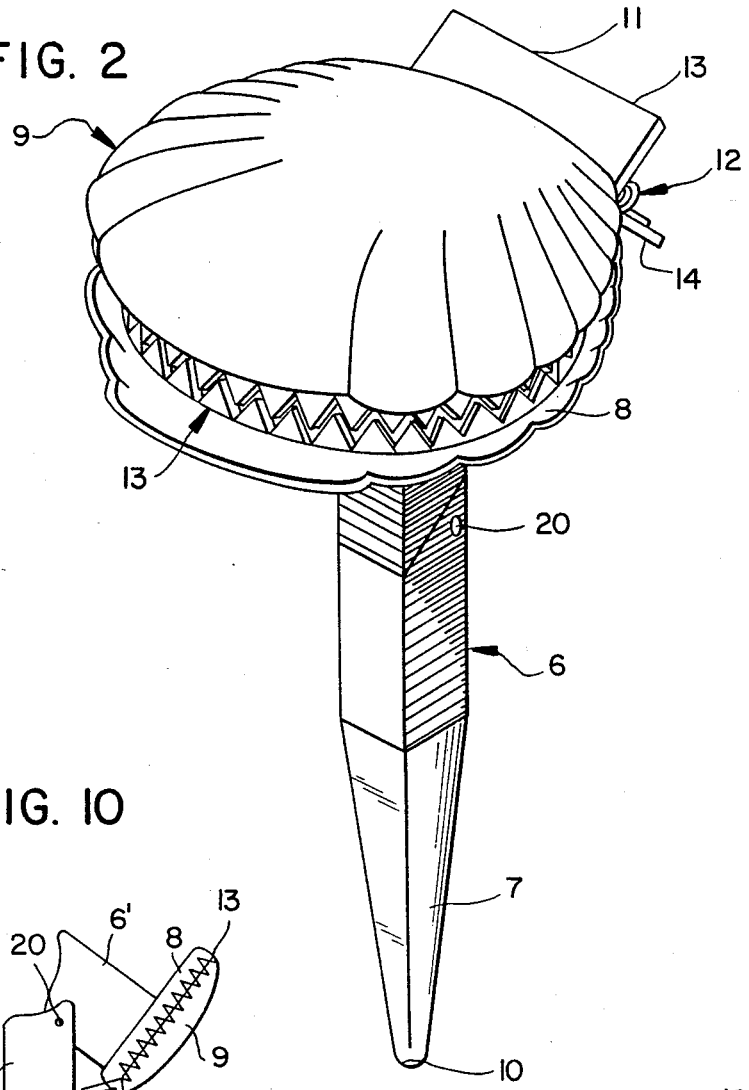
FIG. 2 is a detail perspective view of the invention showing the sand clamp.

The blanket is shown attached to the ground by means of sand clamps 5, described in more detail below in connection with FIG. 2.

The sand clamp 5 has an elongate shaft 6 terminated downward in a spike 7 with a sharp or rounded point 10 at the bottom end, and a pair of clamp shells consisting of a lower shell 8 and an upper shell 9, joined together at a hinge section 11, having a spring 12 engaging the pair of shells providing a spring bias urging the upper and lower shells together, so that two sets of mating teeth 13 can grip the edge of the blanket and hold it down to prevent it from flapping in gusts of wind. The hinge 11 may be equipped with two finger grips 13,14 that can be gripped to open the shells 8,9.

Figure 10:
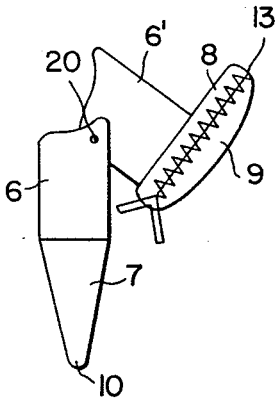
FIG. 10 is a diagrammatic elevational view of the clamp 5 in partially folded condition.

The shaft 6 advantageously has a hinge point 20, that allows the clamp to be folded as seen in FIG. 10 to save storage space.

Figure 3:
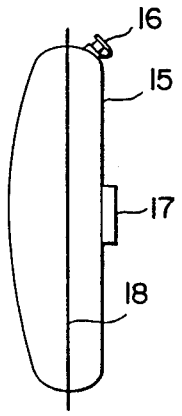
FIG. 3 is a side view showing an inflatable pillow in inflated condition.

FIG. 3 shows a side view of an inflatable pillow 15, having a nozzle 16 for inflating or deflating the pillow, and a tab 17 of matching hook and loop type material, matching the tabs 3 on the blanket 1. The inflatable pillow 15 may be made of any suitable plastic material such as vinyl, rubberized nylon, dacron or the like. It is formed advantageously as two half parts joined at a welded seam 18.

Figure 4:
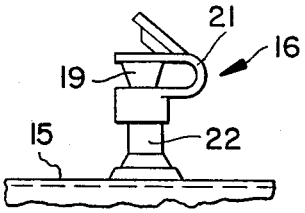
FIG. 4 is an elevational diagrammatic view showing an inflating air nozzle.

A nozzle 16 is seen in greater detail in FIG. 4, and is of conventional construction with an air stop 19 affixed by a strap 21 to an outlet 22, for admitting or releasing air to the pillow 15.

Figure 5:
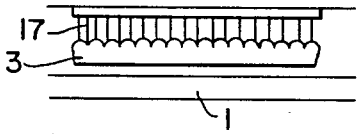
FIG. 5 is a side view showing a hook and loop type tab.

A tab 3 of hook and loop type material is seen in FIG. 5, which is in mating connection with the tab 17 of matching material. Either tab 3 or 17 may be attached to the blanket 1 or the pillow 15.

Figure 6:
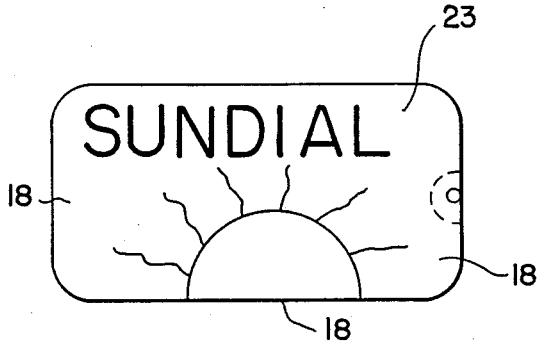
FIG. 6 is an elevational view of the inflatable pillow.

FIGS. 6–9 show a construction of a pillow 23 which is suitable for carrying the blanket and other implements. FIG. 6 shows the pillow 23 from the side showing ornamentation or promotional designs on the side.

Figure 7:
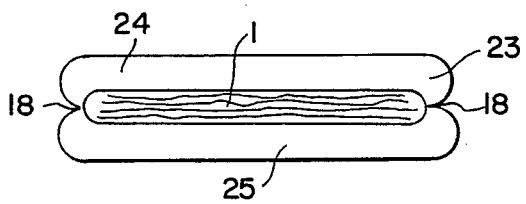
FIG. 7 is a plan diagrammatic view of the inflatable pillow.

FIG. 7 is a top-down view showing the pillow folded to enclose a folded blanket 1 between its two half parts 24,25 which are joined along the edges in a seam 18 to form a pouch.

Figure 8:
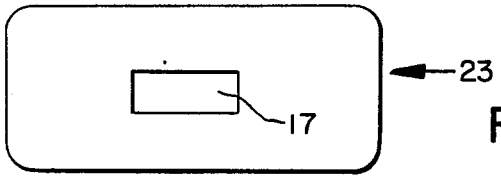
FIG. 8 is a bottom view of the inflatable pillow showing a matching hook and loop type tab.

FIG. 8 is the pillow of FIG. 6, seen from the other side showing the hook and loop type tab 17.

Figure 9:
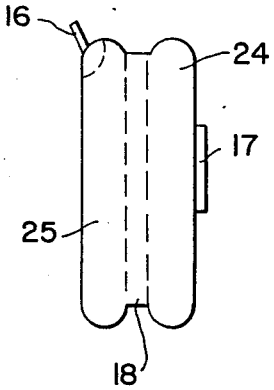
FIG. 9 is an end view of the pillow showing that it can be folded into a carrying case.

FIG. 9 is an end view of the folding pillow 23, showing the two half parts 24, 25 joined by the seam 18.

We claim:

1. In combination, a flexible, foldable beach blanket of a sufficient size to support fully the body of a sunbather in any horizontal position on said blanket, including the longitudinal and transverse positions, said blanket having a plurality of spaced tabs of a hook and loop type fastener adjacent to and surrounding the perimeter of said blanket, and a pillow having on at least one of its sides a tab of hook and loop type material for releasable attachment of said pillow to any one of the plurality of hook and loop type fastener tabs along the perimeter of said beach blanket, whereby as the sun changes its position, a sunbather can reposition and releasably fasten the pillow, relative to the blanket, and rool over to a new position on the blanket, thereby eliminating the task of repositioning the blanket relative to the sun as the sun changes its position.

2. A beach blanket according to claim 1, wherein said pillow is inflatable and includes inflating and deflating means.

3. A beach blanket according to claim 2 including a plurality of sand clamps, each having a spike with a point at one end for driving the spike into the sand, and a spring-biased clamp section on said spike for clamping attachment to said perimeter of the beach blanket.

4. A beach blanket according to claim 3, wherein said sand clamp includes an upper and a lower clamp shell, a hinge for joining said shells, a shell perimeter on said shell, and a plurality of inward facing teeth along said shell perimeter for gripping the perimeter of said blanket.

5. A beach blanket according to claim 4 including a spring in operative engagement with said shells for spring biasingly urging said shells together.

6. A beach blanket according to claim 2, wherein said inflating and deflating means include an air nozzle.

7. A beach blanket according to claim 1, wherein said pillow is foldable to form a carrying bag.

8. A beach blanket according to claim 1, wherein said beach blanket has polygonal shape and has numbers imprinted among said perimeter.

9. A beach blanket according to claim 8, wherein said polygonal shape is octagonal.

10. A beach blanket according to claim 8, wherein said numbers range from 1 to 12.

* * * * *